United States Patent [19]

Pines et al.

[11] Patent Number: 4,504,549

[45] Date of Patent: Mar. 12, 1985

[54] ELASTOMERIC SILICONE FINISHES APPLIED TO SUBSTRATES AND METHOD OF PREPARING SAME

[75] Inventors: Arthur N. Pines, Katonah; Angelo J. Sabia, Yorktown Heights, both of N.Y.

[73] Assignee: Union Carbide Corporation, Danbury, Conn.

[21] Appl. No.: 496,397

[22] Filed: May 20, 1983

[51] Int. Cl.[3] ..... B32B 9/04

[52] U.S. Cl. ..... 428/447; 427/387; 427/389.8; 427/389.9; 427/391; 427/392; 428/264; 428/266; 428/268; 428/452

[58] Field of Search ..... 427/387, 389.9, 393.4, 427/391, 392, 389.8, 389.7; 428/447, 452, 262, 266, 264, 268

[56] References Cited

U.S. PATENT DOCUMENTS

| | | | |
|---|---|---|---|
| 4,184,004 | 1/1980 | Pines et al. | 428/413 |
| 4,221,688 | 9/1980 | Johnson et al. | 525/119 X |
| 4,244,849 | 1/1981 | Saam | 428/447 X |
| 4,273,634 | 6/1981 | Saam et al. | 204/159.15 |
| 4,277,382 | 7/1981 | Lin et al. | 428/447 X |
| 4,288,356 | 9/1981 | Huebner et al. | 525/100 X |
| 4,341,842 | 7/1982 | Lampe | 427/387 X |

OTHER PUBLICATIONS

Weyenberg, J. of Polymer Science, Part C., No. 27, (1969).

Ultratex ® ESB Technical Bulletin, Ciba Geigy.

Isharani, "Ultratex-A New Breed of Textile Finish", Ciba Geigy.

Rooks, "New Developments in Silicone Emulsion Polymers as Textile Finishes", J. American Assoc. of Textile Chemists and Colorists, vol. 4, No. 1, (1972).

*Primary Examiner*—S. L. Childs

*Attorney, Agent, or Firm*—Paul W. Leuzzi, II

[57] ABSTRACT

An elastomeric silicone finish is prepared from a silicone system comprising a blend of silanols and crosslinable silicone intermediates. The blend is applied to the desired substrate and thereafter catalyzed and cured to obtain an elastomeric finish.

19 Claims, No Drawings

ELASTOMERIC SILICONE FINISHES APPLIED TO SUBSTRATES AND METHOD OF PREPARING SAME

BACKGROUND OF THE INVENTION

1. Field of the Invention

This invention relates to a silicone system which provides an elastomeric silicone finish and methods of preparation thereof. The silicone system is prepared from a blend of silanols and crosslinkable silicone intermediates. This silicone system can be used in combination with other known finishing agents.

2. Description of the Prior Art

Silicone products have been used extensively in the textile industry for more than twenty years as water repellents, antifoams, lubricants, softeners and the like. The most important silicone products have been dimethylpolysiloxane, used as a softener, and methylhydrogenpolysiloxane, used as the base for silicone water repellents.

These silicone products, and others, have advantages over hydrocarbon compounds, paraffin waxes and fatty acid waxes, especially in regards to processing and the ultimate properties of the treated materials. Because of these advantages organosilicon polymers as textile chemicals were explored, resulting initially in U.S. Pat. No. 2,891,920 which taught the manufacture of emulsion polymerized dimethyl polysiloxanes.

Some ten years later Weyenberg published a written reference to organosilicon polymers in textile chemicals. *Journal of Polymer Science,* Part C, No. 27 (1969). And more recently, the specific application of these silicones polymers as a textile finish has been made by Rooks in *Textile Chemist and Colorist,* Vol. 4, No. 1, January 1972. The Rooks article specifically referred to the use of silanol endblocked dimethylpolysiloxane emulsion polymers with monomeric methyltrimethoxy silanes as the crosslinker and an organo tin catalyst. The Rook article noted that the use of these ingredients in fortifying or improving the durable press performance of polyester/cellulosic blends was its most important application. However, this technology proved commercially unacceptable because of its lack of consistency under mill conditions and the occurrence of silicone spots on the fabric.

Recently, an elastomeric silicone system has been introduced as a textile finish. This system is reported to impart improved resilience and stretch, shape recovery and dimensional stability to knitted and stretched woven fabrics. This silicone system consists of three emulsion components, the components are a high molecular weight silanol fluid with a dimethylmethylhydrogen fluid correactant and a zinc 2-ethylhexonate catalyst. The system is in emulsion form, which limits the ability of formulators to add value to the component materials and is subject to critical operating conditions which if not met could result in a dangerous evolution of hydrogen.

Despite these recent advances there continues a need for a silicone system that provides a better elastomeric finish that is easier to employ and which acts as a softener by itself or can be used as a component in a durable resin bath. Additionally, the silicone system must be stable and impart formulation latitude so as to be acceptable across the spectrum of mill operations. Finally, it is important that the silicone system be easily catalyzed and preferably employ the same catalyst as found in a typical durable press resin bath.

SUMMARY OF THE INVENTION

A silicone system prepared from a blend of silanols and crosslinkable silicone intermediates. Said silicone system being capable to form a elastomeric film which functions as a softener, a water repellant and imparts resiliency and extensibility. Furthermore, the present silicone system can not only be used alone, but also finds great utility as a component in a durable press resin bath. This silicone system is remarkably stable and provides a great amount of formulation latitude in textile finishes. Additionally, the elastomeric finish has been shown to provide a performance which can be varied by the degree of functionality or molecular weight of the crosslinkable silicone intermediate. Catalysis for the present system is much less critical than previous systems in that any variety of acid catalyst can be employed in small amounts. Of particular advantage is the fact that the present silicone system is catalyzed by any conventional durable press resin catalyst, thereby eliminating the need for a two-catalyst system.

DETAILED DESCRIPTION OF THE INVENTION

In accordance with the present invention, there is provided a silicone system suitable to provide an elastomeric finish upon curing. The silicone system is prepared by reacting a silane and a silanol to obtain a crosslinkable silicone intermediate which is thereafter reacted with a second silanol to obtain a silicone composition which, when catalyzed, can be used as an elastomeric finish or coating for textiles, paper, cellulose materials, glass fibers and mineral substrates. The elastomeric finish or coating provides a film which is soft, resilient and durable. It is also believed that this film may impart lubricity and adhesive release properties.

The silanes which are suitable for use in preparing the crosslinkable silicone intermediate contain those generally represented by the formula:

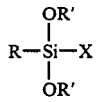

I wherein R is individually hydrogen, OR′ or a substituted or unsubstituted hydrocarbon radical containing from 1 to 12 carbon atoms inclusive, preferably 1 to 3 carbon atoms and most preferably a methyl group, and X is R, OR′ or

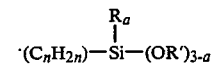

and R′ is individually a hydrocarbon radical containing from 1 to 6 carbon atoms, preferably from 1 to 3 carbon atoms. R′ can be the same or different. The value of n is 1, 2, or 3 and preferably 2 and a is zero, 1 or 2. It is necessary that the silane contain at least 2 and preferably 3 alkoxy groups in order to provide a suitable crosslinkable silicone intermediate.

Illustrative of such silanes include, but are not necessarily limited to, methyltrimethoxysilane, methyltriethoxysilane, ethyltriethoxysilane, methylpentamethoxyldisilylethane, tetraethoxysilane, cyclohexyltriethoxysilane, and methyltripropoxysilane.

Suitable silanols which can be used in the preparation of the crosslinkable silicone intermediate are these represented by the formula:

II

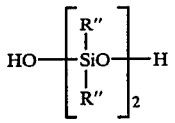

wherein R'' is individually a hydrocarbon radical of from 1 to 12 carbon atoms inclusive and may be cyclic or noncyclic, saturated or unsaturated, branched or nonbranched, substituted or unsubstituted and wherein z has a value of from 10 to 500 and preferably having a value of 15 to 150. The commercially available silanols are predominately disilanols, but may contain certain small amounts of mono- and poly-silanols.

For the purposes of the present invention, it is preferred that the silanol be a dihydroxy endblocked dimethyl polysiloxane.

The reaction between the silane as represented by Formula I and the silanol as represented by Formula II takes place under conditions which are not strictly critical. Broadly, however, the reaction will occur within a temperature range of from to 70° to 120° C. Higher and lower temperatures may be employed but are not preferred. A nitrogen purge to remove any alcohol byproducts and unreacted silane ester is recommended, although it is not criterial to the reaction. The reaction product is then heated at reduced pressure to remove all volatile products. Along these lines, time and temperature will affect the reaction rate but are also not strictly critical. What is required in determining reaction conditions are those conditions necessary to obtain a condensed product. The molar ratio of silane to silanol should, at a minimum, be stoichemetrically equivalent, which requires that there be 2 moles of silane per mole of silanol to get a double end-blocked crosslinkable silicone intermediate. No known adverse effect is believed to exist, however, when single end-blocked crosslinkable silicone intermediates are obtained.

It is very important that when the reaction is run only one of the alkoxy groups is removed. To accomplish this specific catalysts are highly recommended. Illustrative of such catalysts which can accomplish this feat are potassium carbonate sodium methoxide and potassium acetate preferably potassium carbonate.

The resultant crosslinkable silicone intermediate is generally represented by the formula:

III

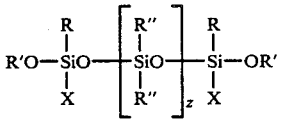

wherein X, R, R' and R'' and z are all as previously defined.

The crosslinkable silicone intermediate represented by Formula III is subsequently mixed with a second silanol to obtain the blend which will subsequently be catalyzed and cured. Suitable silanols for this subsequent step are those of the general formula:

IV

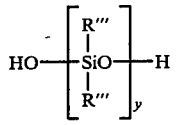

wherein R''' individually has the same designation as that previously set forth for R'' and wherein y equals 185 to 3500 preferably 750 to 3500. It may be possible to employ silanols where y is greater than 3500, but such silanols are not preferred due to processing difficulties.

It should be pointed out that the silanol of Formula II and the silanol of Formula IV can be interchanged. Although this will increase the viscosity of the crosslinkable silicone intermediate, it is believed to be useful for the purposes of the present invention. If such interchanges do occur, it will be necessary when blending the crosslinkable silicone intermediate with the subsequently added silanol to use a ratio of from 10 parts to 75 parts by weight of the crosslinkable silicone intermediate for every 90 to 25 parts by weight of the subsequently added silanol respectively.

In the event the interchange previously mentioned does not occur the weight ratio of crosslinkable silicone intermediate to subsequently added silanol should be from 10 to 50 parts by weight of the crosslinkable silicone intermediate to 90 to 50 parts by weight of the subsequently added silanol respectively.

The selection of a value for z and y in the silanols represented by Formulas II and IV respectively is made to meet the specific requirements in performance properties, such as flexability, resiliency and durability, of the ultimate elastomeric finish. The lower the value of z and/or y, the more brittle and less elastic the ultimate finish will be, conversely the higher the value of z and/or y, the more elastic the ultimate finish will be. In this manner formulators can with ease and convenience control the finish applied to the end products.

In the normal application of a finish, such as a textile finish, the crosslinkable silicone intermediate and the second silanol are preferably emulsified. This, however, is not a critical limitation insofar as nonemulsified blends of the crosslinkable silicone intermediate and silanol in the presence of a catalyst will work. When an emulsion system is employed the emulsifier can be nonionic, cationic or anionic, preferably a nonionic emulsifier is used. Exemplary of nonionic emulsifiers include, but are not limited to, alkylphenol ethoxylates, primary and secondary alcohol ethoxylates, polyoxyethylene lauryl ethers. Exemplary of the anionic emulsifiers are alkyl benzene sulfonates and, sodium lauryl sulfate. Exemplary of the cationic emulsifier is trialkyl ammonium chloride.

The elastomeric finish is prepared by applying to the substrate, be it textile, paper, fiberglass or other, a blend or emulsion together with catalyst and, optionally, any other suitable finishing component and thereafter curing the coating onto such surface. Suitable catalysts which can be added to the blend of crosslinkable silicone intermediate and second silanol include those commonly referred to as acid catalysts. Illustrative of such catalysts include, but are not necessarily limited to, the metal salts of strong acids, e.g. zinc nitrate, aluminum sulfate, zirconium acetate or zinc sulfate; metal halides, e.g. zinc chloride, magnesium chloride, aluminum chloride; metal soaps, e.g. zinc-2-ethylhexonate, dibutyltindilaurate or dibutyltin diacetate; non-polymeric anhydrides, e.g. tetrapropenyl succinic anhydride; and butyl acid phosphate. The catalyst should preferably be added to the blend and/or emulsion and thus would not be present when the emulsion or blend is made to obtain optimum shelf life.

Curing is accomplished by any of a variety of methods commonly known to those skilled in the art. A curing method commonly employed is a heating oven whereby the finish is cured onto a desired substrate.

In one embodiment of this invention, treatment of the textile material with the elastomeric finish of the present invention and treatment with a durable press resin (also known as "creaseproofing agent" or "textile resin") are carried out together, i.e. in the same bath. The durable press resins are known in the art and include aminoplast resins, epoxides, aldehydes, aldehyde derivatives, sulfones and sulfoxides. Aminoplasts are preferred durable press resins as they are relatively inexpensive. Suitable durable press agents are disclosed in "Crease-proofing Resins for Wash-and-Wear Finishing" by A. C. Nuessle, Textile Industries, October 1959, pp. 1-12.

Typical aminoplast durable press resins include the urea-formaldehyde condensates, e.g. methylolated ureas and alkyl ureas, etc.; melamine-formaldehyde condensates, e.g. tri, tetra and penta methylol and methoxymethyl melamines, etc.; alkylene ureas, e.g. dimethylol ethylene or propylene urea, dihydroxydimethylol ethylene urea and various alkoxymethyl derivatives thereof, etc.; carbamates, e.g. dimethylol alkyl and alkoxyalkyl carbamates, etc.; formaldehyde-acrolein condensation products; formaldehyde-acetone condensation products; alkylol amides, e.g. methylol formamide, methylol acetamide, etc.; alkylol acrylamides, e.g. N-methylol methacrylamide, N-methylol-N-methyacrylamide, N-methylol methylene-bis(acrylamides), methylene bis(N-methylol acrylamide), etc.; diureas, e.g. trimethylol and tetramethylol acetylene diureas, etc.; triazones, e.g. dimethyl N-ethyltriazone, N,N'-ethylenebis(di-methylol triazone), etc., urons, e.g. dialkoxymethyl uron, etc., and the like.

Typical epoxide durable press resins include the diglycidyl ethers of polyols such as ethylene glycol diglycidyl ether and diepoxides such as vinyl cyclohexene dioxide. Typical aldehyde creaseproofing agents include formaldehyde, glyoxal and alpha-hydroxypivaldehyde. Typical aldehyde derivative creaseproofing agents include 2,4,6-trimethylol phenol, tetramethylol acetone, diethylene glycol acetal and pentaerytheritol bis acetal.

When the durable press resin and the elastomic finish of the present invention are applied to the textile material from a single bath, a cure catalyst for the durable press resin is generally employed. The choice of catalyst is governed by the particular durable press resin. By way of illustration, catalysts such as magnesium chloride, zinc chloride, zinc nitrate, zirconium acetate, and amine hydrochlorides can be used with aminoplasts. Moreover, the catalyst suitable for curing the durable press resin will also cure the elastomeric finish. The cure of the durable press resin is usually effected at an elevated temperature (e.g. from 150° C. to 175° C.) and the durable press resin and the elastomeric finish of the present invention can thus conveniently be simultaneously cured.

The treatment of this invention can be employed in conjunction with any other treating steps and treating materials which are conventionally employed in the textile finishing art.

Whereas the exact scope of the instant invention is set forth in the appended claim, the following specific examples illustrate certain aspects of the present invention and, more particularly, point out methods of evaluating the same. However, the examples are set forth for illustration only and are not to be construed as limitations on the present invention except as set forth in the appended claims. All parts and percentages are by weight unless otherwise specified.

EXAMPLES (I) Fabric Identification (Test Fabrics Inc., Middlesex, NJ)

(A) 100% texturized polyester double knit jersey, style 720

(B) 100% bleached cotton single knit, sport shirt weight, style 459

(C) 50/50=Polyester/cotton single knit, tubular, style 7421

(D) 65/35=Polyester/cotton woven fabric, Type 190, 3 oz./yd$^2$

The procedural evaluations were run in accordance with the following AATCC and ASTM test methods.

(II) Test Procedures (A) Evaluation of Wettability, AATCC Method 79-1979

(B) Elmendorf Tear Resistance, ASTM Method D-1424-75

(C) Conditioning Textiles for Testing, ASTM Method D-1776-79

(D) Applicator: Werner Mathis Padder, Model VF-9779

(E) Wash Cycle Kenmore Machine Model 29601 4# Load 95 gms A$^2$ TC$^2$ Detergent 124/Cycle Medium water level Wash/rinse cycle=120° F./105° F.

(F) Dry Cycle Kenmore Dryer, Model 7218601W 25 Min. @ "Normal" setting

The invention can be used for the preparation of a remarkably stable emulsion of two reactive intermediates which when catalyzed produced a crosslinked network which encapsulates or reacts with textile, cellulosic, glass fiber, mineral substrates. Crosslinking is achieved via water evaporation and a short elevated temperature catalytic cure.

EXPERIMENTAL

EXAMPLE I $$(MeO)_2\overset{\overset{Me}{|}}{Si}O\,(Me_2SiO)_{27}\overset{\overset{Me}{|}}{Si}(OMe)_2$$ Preparation To a 1000 ml. 3 necked round bottomed flask equipped with a magnetic agitator, a thermometer fitted with a Therm-O-Watch regulator, an inlet tube for nitrogen and a distillation column packed 18" with ¼" glass helices and fitted with a distillation head, receiver and vent to the hood via −80° C. cold traps, there was charged:

503 g silanol endblocked poly(dimethyl siloxane) having the following properties: wt% OH: 1.69, viscosity 54.1 cs. at 25° C.; 81.6 g $MeSi(OMe)_3$ at 99.7% purity; 4.4 g pulverized $K_2CO_3$ anhydrous. The system was heated to 85° C. with agitation and 0.2 ft$^3$ $H_2$/Hr. until 1 mole ethanol per mole of $MeSi(OMe)_3$ charged was removed. Treated 18 hours at 90° C. with 0.5 $ft^3$ $N_2$/Hr purge. The crude reaction product was then vacuum stripped at 100° C./0.2 mm to remove all volatiles. The compound was refined by pressure filtration through a 1–2μ pad.

The '$MD_{27}M$' compound had the following properties:

| | |
|---|---|
| Viscosity cs. @ 25° C. | 30.0 |
| $n_D^{25}$ | 1.4013 |
| Wt % methoxy: | |
| found | 5.3 |
| calculated | 5.8 |
| Residual silanol | <200 ppm |

IR Spectroscopy: Spectrum consistent with anticipated structure showing disappearance of silanol absorption and appearance of SiOMe at 2840 $cm^{-1}$.

Gel Permeation Chromatogram: Molecular weight distribution in full agreement relative to starting silanol endblocked fluid.

EXAMPLE II

Additional examples of polyalkoxy endblocked dimethyl silicones were prepared in a manner essentially identical to that described in Example I.

Table I summarizes all methoxyendblocked silicones prepared and their properties. Table II lists the reagents to prepare these compounds. The stoichiometries employed are calculated on the basis of 2 moles of polymethoxy silane per mole of silanol fluid. In the cases where $MeSi(OMe)_3$ was used, a 20–50% excess was employed to compensate for volatility losses.

$$'M = (MeO_2)\overset{\overset{Me}{|}}{Si}O_{0.5}$$

$$''M = (MeO_2)\overset{\overset{Me}{|}}{Si}C_2H_4\overset{\overset{OMe}{|}}{\underset{\underset{OMe}{|}}{Si}}O_{0.5}$$

$$'''M = (MeO)_3SiC_2H_4\overset{\overset{OMe}{|}}{\underset{\underset{OMe}{|}}{Si}}O_{0.5}$$

$$D = Me_2SiO$$

$$(MeO)_3SiC_2H_4\overset{\overset{Me}{|}}{Si}(OMe)_2,$$

a new polymethoxy silane, was produced by the Pt catalyzed reaction of $MeSiHCl_2$ with $ViSi(OMe)_3$, esterified with methanol an refined via distillation. The compound has the following properties:

| | |
|---|---|
| Boiling Point | 55° C./0.3 mm Hg |
| $n_D^{25}$ | 1.4104 |
| Isomer ratio (wt %): | |
| $(MeO)_2\overset{\overset{Me}{|}}{Si}CH_2CH_2Si(OMe)_3$ | 86 |
| $(MeO)_2\overset{\overset{Me}{|}}{Si}\overset{\overset{Me}{|}}{C}H\,Si(OMe)_3$ | 14 |

TABLE II

Reagents Used to Prepare Polymethoxyendblocked Dimethyl Silicones

| CSI Code No. | Compound Formula | $K_2CO_3$ g | Silane gms. | Silane Composition | Silanol Fluid g | Silanol Fluid Visc. cps. | Silanol Fluid wt % OH |
|---|---|---|---|---|---|---|---|
| A | '$MD_{27}M$' | 4.4 | 81.6 | $Me\,Si(OMe)_3$ | 503 | 54.1 | 1.69 |
| B | "$MD_{27}M$" | 4.7 | 127 | $(MeO)_2\overset{\overset{Me}{|}}{Si}C_2H_4Si(OMe)_3$ | 503 | 54.1 | 1.69 |
| C | '$MD_{112}M$" | 0.65 | 4.9 | $MeSi(OMe)_3$ | 103.8 | 144 | 0.75 |
| D | "$MD_{112}M$" | 1.1 | 6.35 | $(MeO)_2\overset{\overset{Me}{|}}{Si}C_2H_4Si(OMe)_3$ | 103.8 | 144 | 0.75 |
| E | "'$MD_{112}M$"' | 0.5 | 6.75 | $(MeO)_3SiC_2H_4Si(OMe)_3$ | 103.8 | 144 | 0.75 |

TABLE I

Polymethoxy Endblocked Dimethyl Silicones and Their Properties

| Compound CSI[a] Code No. | Compound Formula | Visc.[b] | 25 $n_D$ | wt % Methoxy Found | % Content Calculated |
|---|---|---|---|---|---|
| A | '$MD_{27}M$' | 30 | 1.4013 | 5.3 | 5.8 |
| B | "$MD_{27}M$" | 72 | 1.4071 | 9.2 | 10.1 |
| C | '$MD_{112}M$" | 195 | 1.4032 | 1.3 | 1.5 |
| D | "$MD_{112}M$" | 380 | 1.4045 | 2.7 | 2.8 |
| E | "'$MD_{112}$"' | 510 | 1.4046 | — | — |

Residual silanol content in all preparations = less than 200 ppm.
[a]CSI - crosslinkable silicone intermediate
[b]in cps at room temperature Formula Code:

EXAMPLE III

Preliminary crosslinking studies were conducted by casting acid catalyzed dilute solutions and emulsions of the crosslinkable silicone intermediates (CSI) with and without blends of silanol fluids having viscosities of 1,000–50,000 cs. in laboratory test aluminum cups. In all cases acid catalysts was required for crosslinking to occur. Butyl phosphoric acid (BPA) is highly effective since it is compatible both in oil and water phases. The best elastomeric films were obtained when silanol fluids were admixed with the CSI in ratios of 25/75, 50/50 and 75/25. When the CSI fluid itself was tested a highly crosslinked, friable silicone film was obtained that was deemed unsatisfactory as a textile elastomeric finish.

Concentrated nonionic emulsions of CSI and CSI/-silanol fluid blends were prepared using the following materials/procedures.

There was mixed 35.0 gms of CSI/silanol fluid slowly into a solution of 1.75 g of a nonionic surfactant composed of a blend of polyoxyethylene lauryl ethers and 1.75 g $H_2O$ in a plastic beaker. After mixing well 61.35 g water were added until the emulsion was prepared. The emulsion was stabilized by adding 0.1 g. 37% formalin solution and 0.05 g $NaHCO_3$. The pH was adjusted to 5.5 with acetic acid. This 35% active emulsion was diluted with tap water to provide dilute test solutions.

The effect of temperature on crosslinking emulsions of 15–50% CSI/85–50% silanols respectively to provide elastomeric films gave the following results when 2% BAP catalyst (based on silicone solids) was employed. Emulsions comprised of 15/85 and 25/75 mixtures of CSI Code A and 20,000 cstk silanol gave elastomeric films when contacted 2 days at 25° C., 5 hours @50° C. or 4 hrs @100° C. Films from 50/50 mixtures on standing 2 days at 25° C. gave an elastomeric film. At 50° C. the 50/50 mixture film was dry and after 4 hours at 100° C., we observed a friable dry film showing excessive crosslinking. Similarly, a 15/85 blend of Polymethoxy/8,000 cs. silanol fluid respectively gave elastomeric films when treated at the 3 temperature/-time conditions. The results clearly show how elastomeric films can be produced from broad mixture ranges of CSI with silanol fluids of 8,000–20,000 cstk.

Film forming properties of the liquid CSI were demonstrated by preparing 20% solutions of CSA Code C and CSI Code E in tetrahydrofuran and catalyzed with 5% butyl acid phosphate based on silicone. On standing overnight, the solvent evaporated leaving a film via a crosslinking mechanism. Accelerated cure rates were demonstrated via ½ hr treatment at 80° C. Blends comprised of 25/75, 50/50, and 75/25 CSI with silanol fluids (1,000–8,000 cs.) similarly gave films on standing at ambient conditions. A BAP catalyzed silanol control remained fluid showing no propensity for film forming.

EXAMPLE IV

Elastomeric properties were imparted to a variety of fabrics by treatment in a model textile bath which consisted of:

2.85 g 35% silicone emulsion (as per Example III)
0.10 g butyl acid phosphate (10% in water)
97.05 g distilled water Applications conditions were adjusted to achieve 100% fabric wet pick up which upon drying gave 1.0 wt% silicone deposited on the fabric. The dry fabric was cured for 1.5 minutes at 171° C.

Silicone durability on the fabric was determined by washing five times in a 0.15 wt% detergent (AATCC #124) solution at 120° F. for 30 minutes then rinsing at 105° C. Prior to physical property measurements all fabrics were conditioned at 50% relative humidity and 70° F.

Bleached 100% cotton knit, sport shirt weight, style 459 when treated with CSI/silanol fluid mixture gave durable improvements in dimensional stability and tear strength relative to the untreated control. Table III clearly shows linear shrinkage or gain has been diminished by 50% and furthermore, tear strength has been increased 15–20% even after 5 launderings.

TABLE III

100% Cotton Knit treated with CSI/Silanol Fluid Blends

| Silicone Bath Components | | Dimentional Stability, % after 5 launderings | | Tear Strength (Gram) | | | |
|---|---|---|---|---|---|---|---|
| | | | | initial | | after 5 washes | |
| CSI (Code) | Silanol Fluid (Viscosity)[a] | course | wale | course | wale | course | wale |
| C | 8,000 | +12.3 | −11.2 | 2200 | 3000 | 2100 | 3000 |
| D | 8,000 | +9.8 | −11.8 | 2100 | 3000 | 22000 | 3000 |
| C | 20,000 | +9.6 | −10.4 | 2100 | 3000 | 2200 | 3000 |
| D | 20,000 | +9.9 | 10.6 | 2100 | 3100 | 2100 | 3100 |
| D | 1,000 | +10.1 | −10.6 | 2200 | 3100 | 2200 | 2900 |
| — | — | +17.5 | 22.0 | 2500 | 2600 | 2300 | 2500 |

[a]cps at room temperature

EXAMPLE V

100% texturized polyester double kit jersey, style 720 (Test Fabrics, Inc., Middlesex N.J.) was similarly treated with the same finishing bath compositions used in Example IV. Improvements (17–20%) in durable tear strength were measured after 5 launderings. Refer to data in Table IV. It is to be noted that 100% polyester is dimensionally stable.

TABLE IV

100% Texturized Polyester Knit

| Silicone Bath Components | | Tear Strength (grams) | | | |
|---|---|---|---|---|---|
| | | Initial | | 5 washes | |
| CSI Code | Silanol Fluid Visc.[a] | Course | wale | course | wale |
| C | 8,000 | 2200 | 3000 | 2100 | 3000 |
| D | 8,000 | 2100 | 3000 | 2200 | 3000 |
| C | 20,000 | 2100 | 3000 | 2200 | 3000 |
| D | 20,000 | 2100 | 3100 | 2100 | 3100 |
| D | 1,000 | 2200 | 3100 | 2200 | 2900 |
| — | — | 2500 | 2600 | 2300 | 2500 |

[a]cps at room temperature

EXAMPLE VI

This example illustrates the improved tear strength achieved by treating 50/50 polyester/cotton single knit, tubular, Style 7421 with a 1% silicone actives from treating emulsions comprised of 25 parts CSI Code B/75 parts 8,000 cps silanol. For completeness of data, three catalysts were individually tested and comparative data are recorded in Table VI after fabric washing 3 times.

The bath components are listed below.

| | Parts by Weight | | | |
|---|---|---|---|---|
| Components | 1 | 2 | 3 | 4 |
| 35% Silicone Emulsion | 2.9 | 2.9 | 2.9 | 2.9 |
| BAP (10% in Water) | — | 0.2 | — | — |
| $Zn(NO_3)_2$ (25% in $H_2O$) | — | — | 0.4 | — |
| $Zr(OAC)_2$ (25% in $H_2O$) | — | — | — | 0.4 |
| Water | 97.1 | 96.9 | 96.7 | 96.7 |

Table V also shows Lewis acids are effective curing catalysts retaining 80–90% of the applied silicone relative to 60% retention for the noncatalyzed control. The silicone loss before and after washing was determined via atomic absorption for silicon. Table V also shows significant improvements in durable tear strength with up to 30% increase in the fill and 90% increase in warp directions.

TABLE V

| CATALYST | Silicone % Loss After 3 Washes | Tear Strength, grams Initial course | Initial wale | 3 washes course | 3 washes wale |
|---|---|---|---|---|---|
| Control X (Silicone, no catalyst) | 38 | 2600 | 3000 | 2500 | 3100 |
| Butyl Acid Phosphate + silicone | 19 | 2500 | 3100 | 2400 | 3100 |
| $Zn(NO_3)_2$ + silicone | 10 | 2600 | 3000 | 2600 | 3000 |
| $Zr(OAC)_2$ + silicone | 22 | 2500 | 2900 | 2600 | 3100 |
| Control Y (No Silicone, no catalyst) | — | 2300 | 2100 | 2000 | 1600 |

Conditions
(1) Fabric: 50/50 = Polyester/cotton, single knit tubular
(2) Silicone Applied: 25/75 = CSI Code B polymethoxy fluid/L9000(8000), 35% Emulsion.

EXAMPLE VII

This example illustrates the remarkable stability of CSI/silanol fluid emulsions on storage. Silicone mixtures comprised of 25 pts. CSI Code C/75 pts. 8000 cs. silanol fluid and 25 pts. CSI Code D/75 pts. 8000 silanol fluid were emulsified to 35% silicone actives as described in Example III and buffered with $NaHCO_3$. These systems were stored at room temperature and were periodically observed for appearance and gas chromatographically analyzed for free methanol content. The analytical results are displayed below.

| Days Storage | Emulsion Stability Studies: 25/75 CSI Code C/ Silanol wt % Free MeOH | 25/75 CSI Code D/ Silanol wt % Free MeOH |
|---|---|---|
| 1 | 0.005 | 0.026 |
| 14 | 0.005 | 0.046 |
| 28 | 0.01 | 0.075 |
| 84 | 0.005 | 0.065 |

At this point there was no change in the initial appearance of the emulsions and the tests were terminated. Additional methanol was generated by KOH treatment of the emulsions thus conclusively showing the surprising stability of methoxy endblockers in properly buffered emulsions.

EXAMPLE VIII

As in Example IV this example illustrates durable dimensional stability and tear strength improvements for other CSI/silanol fluid systems at 1% silicone solids on 100% cotton knits. Example IV data was based on CSI having chain lengths of 112 dimethyl siloxy units and cured with BAP catalyst. This example was Zn $(NO_3)_2$ catalyzed and containing CSI having chain lengths comprised of only 27 dimethyl siloxy units (relative to 112 dimethyl siloxy units for Example IV). The data in Table VI clearly show that after 3 washes the dimensional stability has been improved 50% (course and wale) and the wale tear strength has increased 15%. These enhancements have been achieved for silicone systems based on 1000–50,000 cs. silanol fluids when blended with 10–50 wt% CSI as per the model finishing bath formulation and cure conditions.

TABLE VI

| TREATMENTS[a] | 100% Cotton, Single Knit: DIMEMSIONAL STABILITY, % 3 WASHES Course | Wale | WETTABILITY, SECONDS INITIAL | 3 WASHES | TEAR STRENGTH GRAMS, 3 WASHES Course | Wale |
|---|---|---|---|---|---|---|
| As Rec'd Fabric | +17.1 | −21.9 | 2 | 1 | 2300 | 2600 |
| (I) 15/85 = CSI Code A/Silanol Fluid | | | | | | |
| Silanol Fluid visc. | | | | | | |
| (1000) cs | +8.9 | −11.2 | 4 | 2 | 2100 | 3100 |
| (8000) cs | +7.8 | −12.1 | 5 | 2 | 2200 | 3000 |
| (20M) cs | +10.8 | −11.5 | 6 | 2 | 2200 | 3000 |
| (50M) cs | +7.7 | −11.4 | 9 | 3 | 2100 | 2900 |
| (II) 15/85 = CSI Code B/Silanol Fluid | | | | | | |
| Silanol Fluid visc. | | | | | | |
| (1000) cs | +10.1 | −12.2 | 300 | 300 | 2200 | 3000 |
| (8000) cs | +12.4 | −12.1 | 300 | 164 | 2200 | 3000 |
| (20M) cs | +13.3 | −13.3 | 300 | 300 | 2200 | 3000 |
| (50M) cs | +11.4 | −12.0 | 300 | 300 | 2100 | 3000 |
| (III) CSI Code B/Silanol (8000 cs) Blends | | | | | | |
| 10/90 | +9.9 | −12.1 | 63 | 3 | 2200 | 3100 |
| 15/85 | +12.4 | −12.1 | 300 | 164 | 2200 | 3000 |
| 25/75 | +8.7 | −12.0 | 55 | 24 | 2100 | 3100 |
| 50/50 | +9.3 | −11.8 | 300 | 300 | 2100 | 3000 |

Notes:
[a]Finishing Bath Formulations 1% Silicone Solids (BOWF)

| | Parts by Weight | | |
|---|---|---|---|
| CSI/Silanol (35%) | 2.9 | — | |
| Zn $(NO_3)_2$ Cat. (25%) | 0.4 | — | |
| Distilled Water | 96.7 | | |

[b]Fabric Wet Pick-Up: 120%
[c]Dry/Cure: 11/2 Min. @171° C.

EXAMPLE IX

This example is illustrative of the broad applicability of imparting durable dimensional stability and tear strength improvements for wide ranging CSI/silanol emulsion systems applied and cured into 50/50 polyester/cotton knits. Here tested were the same silicone formulae employed in Example VIII using Zn $(NO_3)_2$ as the curing catalyst. Table VII shows the composition of the specific treating systems, the weight fabric wet pick up to provide 1% silicone solids, and the cure conditions. Again the data in Table VII clearly show that after 3 washes the course and wale tear strength was improved 25–30% and there was 15–20% improvement in dimensional stability.

Similar improvements were achieved using 1% BAP catalyst.

TABLE VII

| 50/50 Polyester Cotton Knit | | | |
|---|---|---|---|
| TREATMENTS[a] | DIMENSIONAL STABILITY, % 3 WASHES Wale | TEAR GRAMS, Course | STRENGTH 3 WASHES Wale |
| As Rec'd Fabric | −11.7 | 1700 | 2100 |
| (I) 15/85 = CSI Code A/Silanol Fluid | | | |
| Silanol Fluid Visc. | | | |
| (1000) cs | −8.4 | 2300 | 2800 |
| (8000) cs | −9.1 | 2100 | 2900 |
| (20M) cs | −8.6 | 2300 | 3000 |
| (50M) cs | −7.9 | 2200 | 3000 |
| (II) 15/85 = CSI Code B/L9000 | | | |
| Silanol Fluid Visc. | | | |
| (1000) cs | −9.6 | 2100 | 2900 |
| (8000) cs | −8.9 | 2400 | 2700 |
| (20M) cs | −8.2 | 2000 | 2900 |
| (50M) cs | −9.2 | 2500 | 3000 |
| (III) CSI Code B/Silanol (8000) Blends | | | |
| 10/90 | −9.1 | 2500 | 2800 |
| 15/85 | −8.9 | 2400 | 2700 |
| 25/75 | −9.8 | 2200 | 3100 |
| 50/50 | −9.2 | 2200 | 2800 |

Notes:
[a]Finishing Bath Formulations 1% Silicone Solids (BOWF)
[b]Experimental Emulsions

| | Parts by Weight | | Parts by Weight |
|---|---|---|---|
| Experimental Silicon Emulsion (35%) | 2.9 | Silicone Fluid | 35.00 |
| Zn $(NO_3)_2$ Cat., (25%) | 0.4 | Nonionic Emulsfier | 1.75 |
| Distilled Water | 96.7 | Water | 63.0 |
| | | Preservative | 0.10 |
| | | $NaHCO_3$ | 0.05 |

[c]Dry/Cure Cycle: 11/2 min @ 171° C.
[d]Fabric Wet Pick-up: 119%

EXAMPLE X

This example is illustrative of 50/50 polyester cotton knit treated with a durable press resin bath to which CSI/silanol fluid emulsion compositions have been added. The results clearly show the entire bath treating system has improved physical properties as well as imparting a desirable soft hand relative to the fabric as received and containing resin alone. Thus both CSI containing on average 27 dimethyl siloxy units and endblocked with dimethoxy or tetramethoxy clusters were blended with 1,000 to 50,000 cs. silanol fluids and after emulsification, directly added to the durable press bath, co-cured with the durable press resin system without additional catalyst. In addition, these silicone emulsion compositions can contain 10–50 wt% CSI solids, the balance being comprised of silanol fluids.

The data in Table VIII shows durable dimensional stability has been improved 50% in both wale and course directions and the tear strength improved 30–40% relative to the untreated fabric. Relative to the 50/50 knit treated with resin only, there are dramatic improvements in both softness and physical properties which are required for the fabric to be commercially acceptable.

TABLE VIII

| 50/50 Polyester Cotton Knit Finished with DP Resin/CSI/Silanol Systems | | | | |
|---|---|---|---|---|
| TREATMENTS- | DIMENSIONAL STABILITY, % 3 WASHES Course | Wale | TEAR GRAMS, Course | STRENGTH 3 WASHES Wale |
| As Rec'd Fabric | −1.4 | −10.3 | 1700 | 2100 |
| Resin Only | +0.9 | −5.2 | 2000 | 1300 |
| (I) 15/85 = CSI Code A/Silanol Fluids | | | | |
| Silanol Fluid Visc. | | | | |
| (1000) cs | 0.0 | −4.8 | 2000 | 2800 |
| (8000) cs | +0.9 | −4.8 | 2100 | 2800 |
| (20M) cs | +0.6 | −4.4 | 1800 | 2700 |
| (50M) cs | +0.2 | −4.7 | 2000 | 2800 |

TABLE VIII-continued

| 50/50 Polyester Cotton Knit Finished with DP Resin/CSI/Silanol Systems | | | | |
|---|---|---|---|---|
| | DIMENSIONAL STABILITY, % 3 WASHES | | TEAR GRAMS, | STRENGTH 3 WASHES |
| TREATMENTS- | Course | Wale | Course | Wale |
| (II) 15/85 = CSI Code B/Silanol Fluids | | | | |
| (1000) cs | +0.8 | −5.0 | 2300 | 2800 |
| (8000) cs | +0.5 | −4.9 | 2000 | 2700 |
| (20M) cs | 0.0 | −5.2 | 2000 | 2900 |
| (50M) cs | +1.1 | −5.2 | 2100 | 2800 |
| (III) CSI Code B/Silanol (8000) cps Blends | | | | |
| 10/90 | +0.6 | −5.0 | 2200 | 2700 |
| 15/85 | +0.5 | −4.9 | 2200 | 2700 |
| 25/75 | +0.5 | −4.9 | 2100 | 2800 |
| 50/50 | +0.2 | −5.5 | 2000 | 2700 |

Notes:

| (A) AFinishing Bath Formulations | Parts by Weight |
|---|---|
| Commercial Durable Press Resin (40%) | 14.0 |
| Zn $(NO_3)_2$ (25%) | 2.1 |
| Experimental Silicone Emulsion (35%) | 2.3 |
| Water | 81.6 |

(B) Dry/Cure Cycle: 11/2 min @ 171° C.
(C) Fabric Wet Pick-Up: 125%
Silicone loading: 1% solids BOWF

EXAMPLE XI

The properties of 65/35 polyester/cotton woven fabric, Type 190, 3 oz/yd$^2$ were improved by treatment with a durable press finishing bath containing CSI/-silanol compounds as a elastomeric softener component. Table IX lists the durable dimensional stability provided by the resin/silicon softener system relative to the as received fabric and the 100% improvements in durable tear strength relative to the durable press treated fabric alone. Illustrated in this example are the utility of 2,000–2,500 mol. weight dimethoxy and tetrmethoxy endblocked silicone fluids admixed with 1,000–50,000 cs. silanol fluids which were added to the treating bath as concentrated emulsions. The wt% polymethoxy end-blocked silicone compounds co-cured with the durable press resin without the need for additional catalyst.

The tear strength of the silicone treated fabric was doubled in both the fill and warp directions. The hand was soft, smooth, and lively relative to the durable press resin treatment alone. These properties are required for fabric to be of commercial utility.

TABLE IX

| 65/35 Polyester-Cotton Woven Fabric Treated with DP Resin/PMEBS/Silanols | | | | |
|---|---|---|---|---|
| | DIMENSIONAL STABILITY, % 3 WASHES | | TEAR GRAMS, | STRENGTH 3 WASHES |
| TREATMENTS | FILL | WARP | FILL | WARP |
| As Rec'd Fabric | −1.3 | −3.0 | — | — |
| Resin Only | 0.0 | −0.8 | 700 | 600 |
| (I) 15/85 = CSI Code A/Silanol Fluids | | | | |
| Silanol Fluid Visc. | | | | |
| (1000) cs | −0.5 | −1.0 | 1400 | 1100 |
| (8000) cs | −0.5 | −1.0 | 1500 | 1200 |
| (20M) cs | −0.5 | −1.0 | 1600 | 1100 |
| (50M) cs | −0.5 | −1.0 | 1500 | 1200 |
| (II) 15/85 = CSI Code B/Silanol Fluids | | | | |
| (1000) cs | −0.5 | −1.0 | 1400 | 1100 |
| (8000) cs | −0.5 | −1.0 | 1400 | 1200 |
| (20M) cs | −0.5 | −1.0 | 1500 | 1200 |
| (50M) cs | −0.5 | −1.0 | 1500 | 1200 |
| (III) CSI Code B/Silanol (8000) cps Blends | | | | |
| 10/90 | −0.5 | −1.0 | 1400 | 1200 |
| 15/85 | −0.5 | −1.0 | 1400 | 1200 |
| 25/75 | −0.5 | −1.0 | 1500 | 1200 |
| 50/50 | −0.5 | −1.0 | 1400 | 1100 |

Notes:

| (A) Finishing Bath Formulations | Parts by Weight |
|---|---|
| Commercial Durable Press Resin (40%) | 14.0 |
| Zn $(NO_3)_2$ (25%) | 2.1 |
| Experimental Silicone Emulsion (35%) | 2.3 |
| Water | 81.6 |

(B) Fabric Wet Pick-Up: 125%
(C) Dry/Cure Cycle: 11/2 min @ 171° C.
(D) 1% Silicone Solids (BOWF)

We claim:

1. A process for imparting an elastomeric finish to a substrate which comprises:

(a) applying to said substrate a silicone blend comprising:

(1) a crosslinkable silicone intermediate selected from the group of silicone compositions of the general formula:

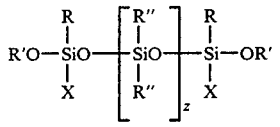

wherein

R is individually hydrogen, OR' or a substituted or unsubstituted hydrocarbon radical containing from 1 to 12 carbon atoms;

R' is individually a hydrocarbon radical containing from 1 to 6 carbon atoms; and X is either R, OR' or $(C_nH_{2n}Si(R)_a(OR')_{3-3}$ wherein n is 1, 2 of 3 and a is 0, 1 or 2;

z has a value from 10 to 500; and R'' is individually a hydrocarbon radical containing from 1 to 12 carbon atoms and may be cyclic or noncyclic, branched or nonbranched, substituted or unsubstituted, or saturated or unsaturated and (2) a silanol selected from the group of silanols of the general formula:

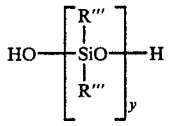

wherein

R''' is individually a hydrocarbon radical containing from 1 to 12 carbon atoms and may be cyclic or noncyclic, branched or unbranched, substituted or unsubstituted or saturated or unsaturated and y has a value of from 185 to 3500; and (b) Catalyzing and curing the silicone blend onto the substrate to provide an elastomeric finish.

2. The process of claim 1 wherein the substrate is selected from the group consisting of textiles, paper, cellulose materials, glass fibers and mineral fibers.

3. The process of claim 2 wherein the substrate is a textile.

4. The process of claim 1 wherein the silicone blend is applied to said substrate in an amount from 0.1 to 10 parts by weight per 100 parts by weight of untreated substrate.

5. The process of claim 1 wherein R is hydrogen or methyl group.

6. The process of claim 5 wherein R is a methyl group.

7. The process of claim 1 wherein R' is a hydrocarbon radical containing from 1 to 3 carbon atoms.

8. The process of claim 7 wherein R' is methyl.

9. The process of claim 1 wherein R'' is methyl.

10. The process of claim 1 wherein X is R.

11. The process of claim 1 wherein X is OR'.

12. The process of claim 1 wherein X is $(C_2H_4)Si(OR')_3$.

13. The process of claim 1 wherein X is $(C_2H_4)Si(R)(OR')_2$.

14. The process of claim 1 wherein z has a value of from 15 to 150.

15. The process of claim 1 wherein R''' is methyl.

16. The process of claim 1 wherein y is 750 to 3500.

17. A process for imparting an elastomeric finish to a substrate which comprises:

(a) applying to said substrate a silicone blend comprising:

(1) a crosslinkable silicone intermediate selected from the group of silicone compositions of the general formula:

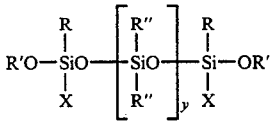

wherein

R is individually hydrogen, OR' or a substituted or unsubstituted hydrocarbon radical containing from 1 to 12 carbon atoms; R' is individually a hydrocarbon radical containing from 1 to 6 carbon atoms; and X is either R, OR' or $(C_nH_{2n})Si(R)_a(OR')_{3-a}$ wherein n is 1, 2 or 3 and a is 0, 1 or 2;

y has a value from 185 to 3500; and R'' is individually a hydrocarbon radical containing from 1 to 12 carbon atoms and may be cyclic or noncyclic, branched or nonbranched, substituted or unsubstituted, or saturated or unsaturated, and (2) a silanal selected from the group of silanals of the general formula:

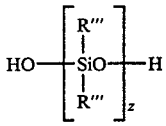

wherein

R''' is individually a hydrocarbon radical containing from 1 to 12 carbon atoms and may be cyclic or noncyclic, branched or unbranched, substituted or unsubstituted or saturated or unsaturated and z has a value of from 10 to 500; and (b) Catalyzing and curing the silicone blend onto the substrate to provide an elastomeric finish.

18. An elastomeric finish imparted on a substrate produced by the process of claim 1.

19. An elastomeric finish imparted on a substrate produced by the process of claim 17.

* * * * *